United States Patent [19]

Jarvis et al.

[11] Patent Number: 4,542,268

[45] Date of Patent: Sep. 17, 1985

[54] BROWNING HEATER FOR A MICROWAVE OVEN

[75] Inventors: George A. Jarvis, New Hope; Larry M. Sivertson, Golden Valley, both of Minn.

[73] Assignee: Litton Systems, Inc., Beverly Hills, Calif.

[21] Appl. No.: 116,073

[22] Filed: Jan. 28, 1980

[51] Int. Cl.[4] ..... H05B 6/64

[52] U.S. Cl. ..... 219/10.55 B; 219/10.55 R; 219/345; 219/411; 219/553

[58] Field of Search ..... 219/10.55 B, 10.55 R, 219/345, 411, 553, 552, 542, 543

[56] References Cited

U.S. PATENT DOCUMENTS

| | | | |
|---|---|---|---|
| 2,742,556 | 3/1956 | Bovenkerk | 219/345 |
| 2,859,321 | 11/1958 | Garaway | 219/345 |
| 2,939,807 | 6/1960 | Needham | 219/345 X |
| 3,031,739 | 5/1962 | Boggs | 219/345 X |
| 3,059,087 | 10/1962 | Perlman | 219/411 X |
| 3,265,861 | 8/1966 | Perlman | 219/411 X |
| 3,513,296 | 5/1970 | Brangs et al. | 219/345 X |
| 3,694,627 | 9/1972 | Blatchford et al. | 219/345 X |
| 3,697,728 | 10/1972 | Stirzenbecher | 219/345 X |
| 4,031,353 | 6/1977 | Segura | 219/345 |
| 4,032,751 | 6/1977 | Youtsey | 219/345 X |

*Primary Examiner*—Philip H. Leung
*Attorney, Agent, or Firm*—John M. Haurykiewicz; Walter R. Thiel

[57] ABSTRACT

A browning heater for a microwave oven. The heater is comprised of a porcelain coated steel cover sheet, a foil resistance heater, a thermal insulation sheet and a stainless steel backplate bound together in order. The heater is mounted on the interior cavity roof of a microwave oven. The heater browns food by means of infrared radiation.

15 Claims, 4 Drawing Figures

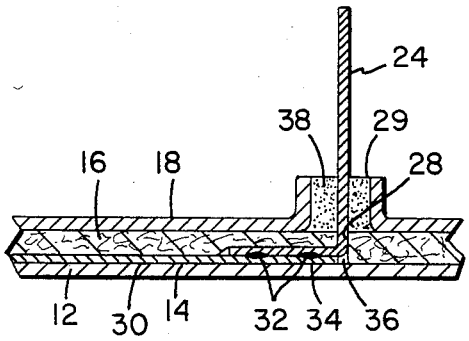
Fig. 3
Fig. 4
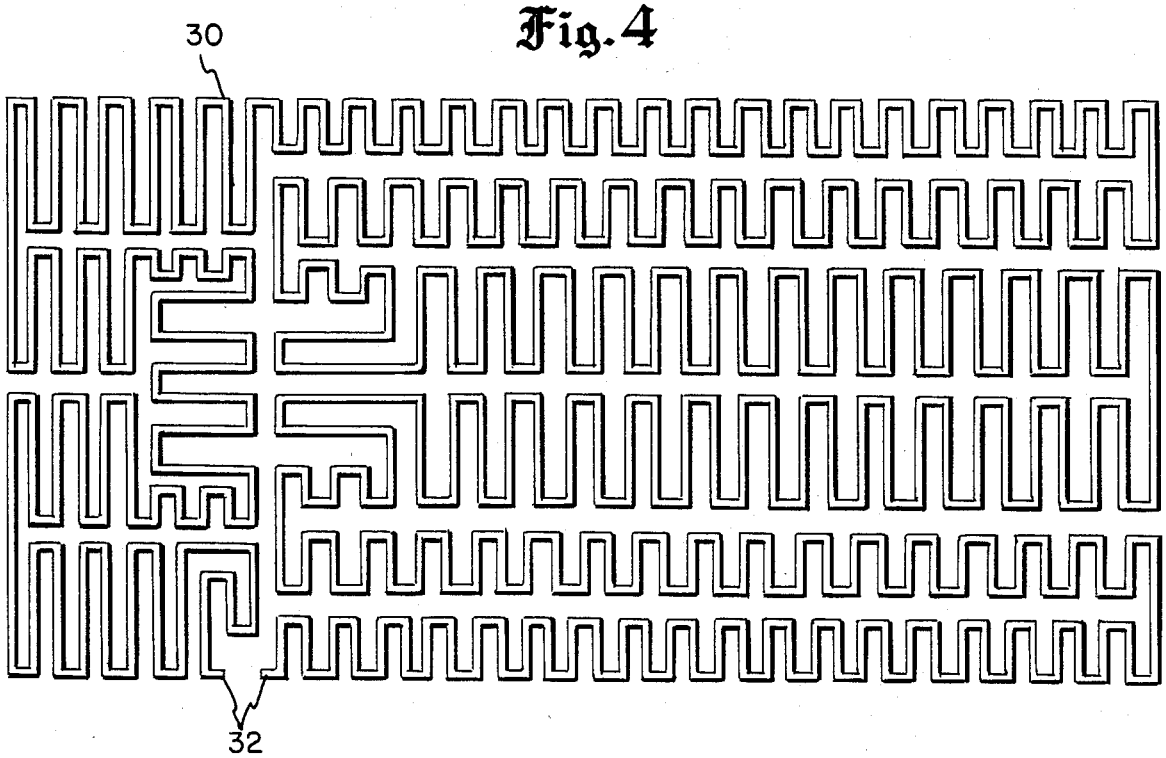

BROWNING HEATER FOR A MICROWAVE OVEN

BACKGROUND OF THE INVENTION

1. Field of the Invention

This invention relates generally to the field of microwave ovens and more particularly to improvements in the food browning units thereof.

2. Description of the Prior Art

It is well known that foods cooked by microwaves do not brown well because of the relatively deep penetration of microwaves into the food. Devices have heretofore been incorporated into microwave ovens which have as their primary function the raising of the surface temperature of the food to a degree higher than that ordinarily achievable by means of microwaves alone in order to brown the food.

The first of these devices, U.S. Pat. No. 3,081,392 to Warner, incorporated a standard electric oven "Cal rod" type resistance heater. Later devices have used additional means, such as mirrors in German Pat. No. 1,049,019, to focus the heat rays on the food. At least one device, U.S. Pat. No. 3,878,350 to Takagi has used a variation on a standard quartz tube. See also U.S. Pat. No. 4,137,442, to Tateda, which is a variable position "Cal rod" type.

A common feature of all these devices is that they substantially intrude into the usable space of the normally small microwave oven cavity.

A second feature of these devices is the multiplication of elements of marginal utility but of great manufacturing expense.

A third feature of many of these devices, especially of those having many elements, is their lack of cleanability. Takagi '350 is a prime example. It incorporates a microwave screen in front of its quartz tubes rendering the device very difficult to clean except by disassembly.

The prior art has had as an object the increase in the surface area heated and planarity to increase uniformity of heating of the food. See Takagi '350. No prior art device has succeeded in this object to the extent of the present invention.

SUMMARY OF INVENTION

Accordingly, it is an object of the present invention to provide a microwave oven browning device that does not occupy a significant amount of usable microwave oven cavity space.

It is a further object of the invention to provide a microwave oven browning device of simple design and low manufacturing cost.

It is a further object of this invention to provide a microwave oven browning device which is easily cleanable.

It is a further object of the invention to provide a microwave oven browning device having a relatively large-area, planar, heated surface.

The present invention achieves these objects by providing a microwave oven browning heater comprising a low-mass, high-emissivity plate, a foil-type resistance heater sheet, a sheet of thermal insulation, and means for holding each of the aforesaid elements in planar abutment in the order indicated. In a preferred embodiment, the plate has a cleanable, high-temperature porcelain enamel on both sides. Some embodiments may also have a low-emissivity backplate to reflect heat rays downward toward the food.

This construction provides for a high wattage infrared heater of a broad, easily cleanable surface area which intrudes into the microwave oven cavity only about one quarter of an inch. Furthermore, each of the above elements are low cost, commercially available and can easily be assembled.

BRIEF DESCRIPTION OF THE DRAWINGS

The particular features of the invention may be better understood in the following detailed description of the preferred embodiment when taken in view of the accompanying drawings, in which like references pertain to like elements throughout the figures.

FIG. 3 is a partial cross-sectional view of the browning heater showing the electrical connector assembly.

FIG. 4 is an exemplary circuit path of the foil heater element.

DESCRIPTION OF THE PREFERRED EMBODIMENT

Figure 1:
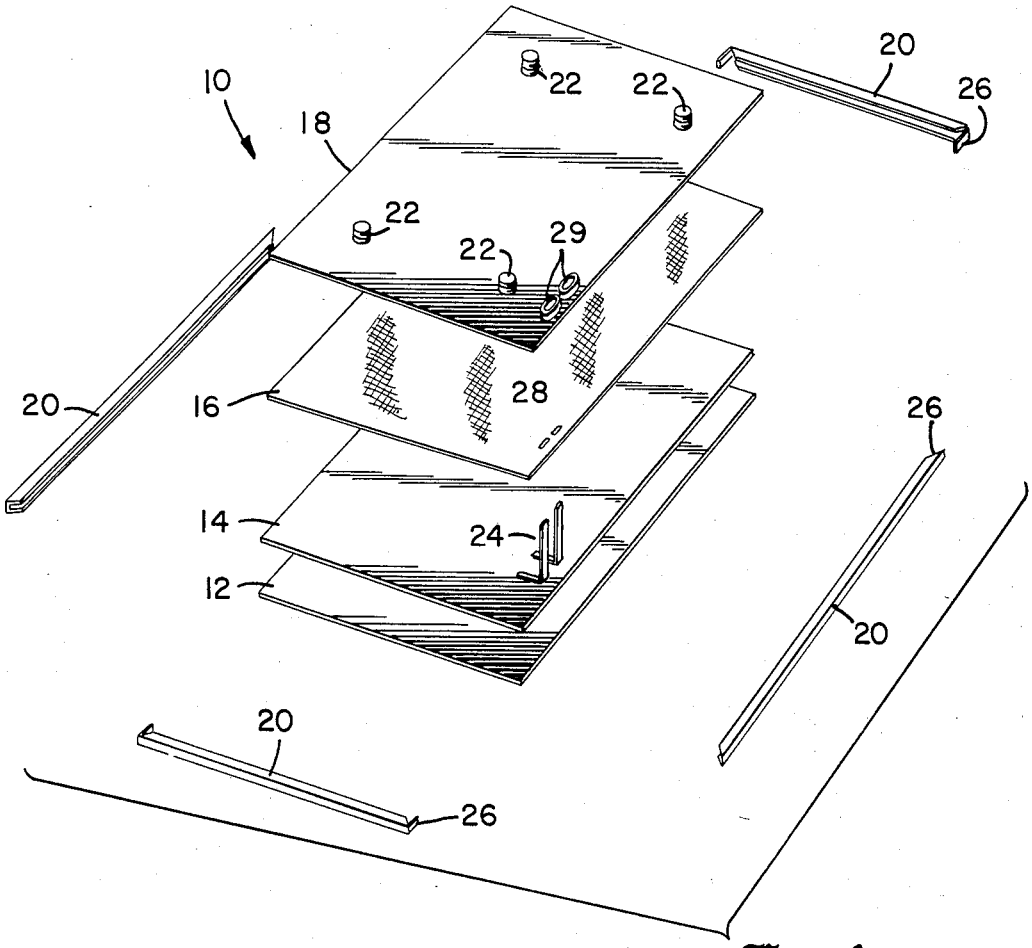
FIG. 1 is an exploded view of the browning heater.
Figure 2:
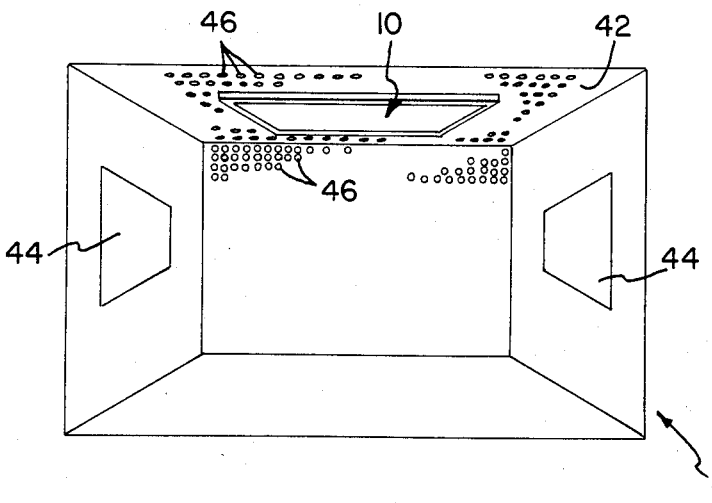
FIG. 2 is a perspective view of the interior of a microwave oven cavity having the browning heater mounted to the top interior surface thereof.

FIG. 1 shows an exploded view of a microwave browning heater 10 according to the present invention. Its elements in order from the bottom are a porcelainized steel plate 12, a foil heater 14, a thermal insulator 16 and a stainless steel backplate 18. These elements are assembled abutting against each other in congruent planar alignment in the order indicated and are held in place by fitting about their edges "U" shaped frame members 20. Once the frame members 20 have been fitted, their abutting corners 26 are brazed to form a unitized heater 10.

The foil heater 14 is an etched foil resistance heating device commercially available from such manufacturers as Thermal Circuits, Inc. of Salem, Mass. or Safeway Products, Inc. of Middletown, Conn. They are comprised of an etched metal foil laid out in a serpentine circuit path 30, as in FIG. 4, and interdisposed between two sheets of glass cloth bonded together by a mica slurry or other high temperature adhesive. The metal foil 30 is a special alloy, such as Ni-CR, that can withstand temperatures above about 850° C.

Affixed to the terminals 32 of circuits path 30 are electrical connectors 24, as can better be seen by reference to FIG. 3. The electrical connector is a L-foot strip of conductive metal whose foot 36 is welded or brazed to terminal 32. Two spot welds 34 are shown in FIG. 3.

In assembly, these connectors 24 are inserted through slots 28 in insulator 16 and holes 29 in backplate 18. Thereafter a ceramic cement 38 is applied to fill holes 29 and prevent connectors 24 from being forced into electrical contact with backplate 18, during thermal expansion of metal foil element 14. One such ceramic cement is known as Fiberfrax ceramic cement and is available from the Carborundum Company of Niagra Falls, N.Y.

The connectors 24 will extend through corresponding apertures in the roof 42 of cavity 40. Conventional means may be used to electrically isolate these connectors from contact with the normally metalic cavity 40.

Porcelainized steel plate 12 is enameled on both sides with a high-temperature porcelain commonly used in pyrolytic self-cleaning ovens. Such a porcelain is chosen to withstand the high temperatures to which the plate 12 will be heated.

The invention may function quite well without a porcelain coating on the outside. However, porcelain adds the ability to be easily cleaned. Ordinary metal rusts at the operational temperatures; and unoxidized stainless steel does not possess the high-emissivity desired in the heated plate.

Plate 12 is porcelainized on the inside also to provide electrical insulation between foil heater 14 and plate 12. Plate 12 is not required to be porcelainized on the inside. A separate electrical insulator may alternatively be used.

If the outer surface of plate 12 is not porcelainized it is preferrably composed of a high-emissivity material so as to emit infrared radiation efficiently.

Further, regardless of composition, plate 12 is preferrably of low mass and high thermal conductivity so as to reach operational temperatures quickly.

Thermal insulator 16 is a high temperature insulator such as Fiberfrax ceramic paper available from the Carborundum Company of Niagra Falls, N.Y. It serves a dual function. First it retards heat transfer upwards toward backplate 18. Second, it provides electrical insulation between foil heater 14 and backplate 18. As it is desired to maximize heat flow donward from foil heater 14, it is necessary to minimize heat transfer up from the foil heater 14. The more insulation in this regard the better. The only limitation would be cost and size.

Backplate 18 is composed of a low-emissivity, low thermal-conductivity metal such as stainless steel. Residual thermal rays penetrating up through insulator 16 will be reflected back downwards. Being reflective, backplate 18 will absorb only a small percent of incident thermal heat. Thus, the temperature at the top surface of backplate 18 will be relatively cool compared to the temperature of foil heater element 14.

Backplate 18 is provided with four mounting studs 22. These can be attached to backplate 18 by means of welding or by stamping them by using a PEM stud technique.

The studs 22 are inserted through holes (not shown) in microwave oven cavity 40 to affix the browning heater 10 to the interior roof 42 thereof. If oven cooling becomes a problem, an additional layer of thermal insulation (not shown) may conveniently be interdisposed between heater 10 and cavity roof 42.

Mounting browning heater 10 on the roof 42 of cavity 40 as indicated prevents the microwave waveguide outlet from being located in its usual position. Takagi '350 maintains the usual waveguide location by effectively spacing the browning device somewhat down into the cavity and allowing the microwaves access to the food portion of the cavity by providing space around the sides of the browning device through which the microwaves travel. To prevent hot greasy air from venting up into the waveguide and there through to the magnetron, a glass, microwave-transparent heat shield is mounted above the browning device.

This construction is unnecessarily complex. The preferred embodiment, herein, provides microwave entry ports located on opposite sidewalls of the cavity as disclosed in U.S. Pat. No. 4,133,997 to Thuleen. Such a location, plus the customary dirt covers (not shown), additionally overcomes the associated problem of hot air rising up through the waveguides to the oven's magnetron (not shown).

Cooling vents 46 may be provided to the degree desirable to prevent the oven from becoming unduly hot. A hot oven is not necessary for effective browning, as the browning is caused by infrared radiation. Also, an air flow aids in removing moisture from the food. A dryer food sometimes browns better.

Additional cooling may be provided by constructing the cavity 40 of a low-emissivity metal such as stainless steel. Infrared energy would not then be absorbed by the cavity's interior surfaces, but, rather would be reflected onto the food to increase browning. Although metal such as stainless steel is relatively expensive, it would greatly increase the thermal efficiency of the oven as shown by U.S. Pat. No. 4,164,643 to Peart et al.

An alternative embodiment may provide for the elimination of backplate 18, as the interior roof 42 of cavity 40 is normally made of metal. If this metal is of high-emissivity, the thermal insulator 16 may be thickened to lessen the amount of thermal energy reaching roof 42. If the cavity is made of low-emissivity metal such as stainless steel, no additional insulation 16 is needed. In this embodiment, browning heater 10 may conveniently be mounted to roof 42 of cavity 40 by placing mounting studs 22 on the frame members 20 or by using an equivalent technique.

Frame members 20 are preferably made of a low-thermal conductivity, microwave reflective material such as stainless steel. For the sake of cleanability and uniformity of appearance, it may also be porcelainized as the cover plate 12. It performs three functions: the aforementioned function of binding the other elements together, the function of thermally isolating the cover plate 12 from the backplate 18 and/or the cavity roof 42, and the function of protecting the foil heater 14 from microwaves.

Frame members 20 may be eliminated in alternative embodiments. For example cover plate 12 may have "U" shaped edges within which the other elements are inserted. If backplate 18 is omitted, the "U" shaped member may carry the mounting studs or other mounting means. Also, the edge of backplate 18 and cover plate 12 may be forced into abutment by suitable attachment means such as rivets, screws, clips, welding or the like. Further, these same means may simultaneously be used to attach the edges to the cavity roof 42. Also, one edge of cover plate 12 may be extended into a fold-over flap to form a backplate 18, the edges of which may be held in abutment with the edges of cover plate 12 as mentioned above. Many other equivalent constructions are likely to occur to those skilled in the art.

Lastly, it should be appreciated that there are many other variations of the preferred embodiment within the scope of the present invention. The browning heater's size and shape may be varied as desired within the power limits of the electrical power source. It has been found that a browning heater dimensioned 9"×10" will draw up to 1500 watts. A larger area heater would preferably use a larger watt capacity source than a standard 115 volt outlet. Also, the larger the area of the heater, the larger is the area of food which may be evenly browned.

Wherefore, in view of the above detailed description, we claim:

1. A microwave browning oven comprising:
   - a metallic cavity having interior surfaces comprising walls
   - and an interior roof;
   - a microwave generating device;
   - a means for communicating microwaves from said device into said cavity;

an infrared heater mounted on the interior roof of said cavity;

said heater including:

a metallic cover sheet;

a resistance heating sheet;

means for electrically insulating said heating sheet from said cover sheet;

a thermal insulator sheet;

means for closely binding and mounting said sheets in the order listed on the interior roof of said cavity, said means for binding and mounting adapted to shield said resistance heating sheet from said microwaves, such that said heater projects into said cavity substantially only the thickness of said sheets as bound.

2. The oven of claim 1 further including a high-temperature porcelain enamel on the outer surface of said cover sheet.

3. The oven of claim 1 wherein said electrical insulating means comprises a high-temperature porcelain enamel on the inner surface of said cover sheet.

4. The oven of claim 1 wherein said mounting means includes:

a low-emissivity metal sheet interdisposed between said thermal insulator and said interior roof of said cavity.

5. An assembly adapted to produce infrared radiation in a microwave oven, comprising:

a metallic cover sheet having both sides thereof enamelled with a high-emissivity, high-temperature porcelain;

a heater sheet;

a thermal insulator sheet; and means for binding said sheets proximate each other in the order listed, said means adapted for mounting said sheets in close abutment onto an interior wall of a microwave oven cavity, said means further adapted to shield said heater sheet from microwaves present in said cavity, whereby said assembly intrudes into said cavity only to the extent of its own volume.

6. The assembly of claim 5 wherein said mounting means includes a metal frame, said frame having a lower flange engaging said cover sheet about all edges thereof; a side member having top and a bottom edges, said bottom edge connected to said lower flange, said top edge carrying one or more upper flange members adapted to have mounted thereon means for mounting said frame to said interior wall such that said upper edge of said side member abuts against said interior wall.

7. The assembly of claim 5 in combination with a microwave oven having a cooking cavity comprised of interior surfaces wherein said assembly is mounted onto the interior roof surface of said cavity.

8. The assembly of claim 5 in combination with a microwave oven having a cooking cavity comprised of interior surfaces wherein said assembly is mounted onto one of said interior surfaces and wherein said one interior surface is comprised of a low emissivity metal.

9. A microwave oven having browning means, said oven including a metallic cavity having walls, said browning means mounted on the interior surface of one of said walls, said browing means comprising:

a thin and substantially planar metallic cover sheet having two sides and at least one edge;

a high-temperature, high emissivity porcelain enamel affixed to and covering both of said sides;

an etched foil resistance heater sheet having a substantially planar serpentine circuit path substantially covering an area of substantially the same size and shape as the area circumscribed by said at least one edge of said cover sheet;

a thin and substantially planar thermal insulator sheet of substantially the same size and shape as the area circumscribed by said at least one edge of said cover sheet;

first means for providing electrical connection of said heater sheet to a power source through at least one aperture in said one wall; and second means for:

i. binding sheets together in the order listed in substantially congruent alignment, ii. electrically isolating said heater sheet from microwave radiation, and iii. mounting said browning means in abutment to said interior surface such that said browning means intrudes into said cavity only to the extent of its own volume.

10. The microwave oven of claim 9 further including a substantially planar, low-emissivity, low-thermal-conductivity metal backplate sheet of substantially the same size and shape as the area circumscribed by said at least one edge of said cover sheet; said backplate interdisposed between said thermal insulator sheet and said interior surface of said one of said walls substantially congruent with said cover sheet.

11. The microwave oven of claim 10 wherein said mounting means includes a plurality of studs mounted on said backplate and extending toward said one of said walls; a plurality of corresponding apertures in said one of said walls through which one each of said plurality of studs extend; and locking means affixed to each of said plurality of studs on the portions thereof extending beyond said one of said walls, said locking means adapted to pull said backplate into abutment with said interior surface.

12. The microwave oven of claim 10 wherein said electrical isolating means comprises means for bringing said at least one edge of said cover sheet into electrical contact with said backplate.

13. The microwave oven of claim 10 wherein said electrical connection means comprises:

at least one aperture mounted in each of said thermal insulator sheet and said backplate sheet in alignment with said at least one aperture in said one of said walls;

at least two low-resistance terminals electrically connected one each to opposite terminals of said circuit path of said heater sheet; at least two low-resistance electrical connectors electrically connected to one each of said at least two terminals; said at least two connectors extending through said at least one apertures in said thermal insulator sheet, said backplate and said one of said walls; said at least two connectors spaced from one another and from said backplate and said one of said walls; and a high-temperature, electrically non conductive cement filling the space between said at least two connectors and said backplate; and means for electrically isolating said at least two connectors from said at least one of said walls.

14. The microwave oven of claim 9 wherein said electrical isolating means comprises electrical contact between said at least one edge of said cover sheet with said one of said walls.

15. The microwave oven of claims 9 or 10 wherein said binding means comprises a metal frame having inwardly projecting lateral flanges; said frame being fitted about the edges of said sheets; said flanges in abutment with the outer surfaces of the outermost of said sheets and adapted to hold said sheets in congruent alignment and planar abutment.

* * * * *